US007249395B2

(12) United States Patent
Brammer, Jr. et al.

(10) Patent No.: US 7,249,395 B2
(45) Date of Patent: Jul. 31, 2007

(54) HAND BRACKET

(75) Inventors: Robert C. Brammer, Jr., Traverse City, MI (US); Charles A. Brammer, Traverse City, MI (US)

(73) Assignee: Stromberg-Carlson Products, Inc., Traverse City, MI (US)

( * ) Notice: Subject to any disclaimer, the term of this patent is extended or adjusted under 35 U.S.C. 154(b) by 175 days.

(21) Appl. No.: 10/977,573

(22) Filed: Oct. 29, 2004

(65) Prior Publication Data

US 2006/0085948 A1 Apr. 27, 2006

Related U.S. Application Data

(63) Continuation-in-part of application No. 29/215,840, filed on Oct. 26, 2004, now Pat. No. Des. 516,406.

(51) Int. Cl.
*E05B 1/00* (2006.01)

(52) U.S. Cl. ..... 16/412; 16/436; 16/DIG. 41

(58) Field of Classification Search ..... 16/412, 16/413, 436, 443, 444, DIG. 40, DIG. 41; 248/254, 256–257, 278.1, 282.1, 261; 411/52, 411/53; 49/460, 461; 312/348.6, 401, 405; 403/381

See application file for complete search history.

(56) References Cited

U.S. PATENT DOCUMENTS

| | | | | | |
|---|---|---|---|---|---|
| 394,252 | A | | 12/1888 | Davis | |
| 704,026 | A | | 7/1902 | Gordon et al. | |
| 1,076,121 | A | | 10/1913 | Houck | |
| 1,179,286 | A | | 4/1916 | Crimmel | |
| 1,284,979 | A | | 11/1918 | Ayers | |
| 1,435,110 | A | | 11/1922 | Efford | |
| 1,572,845 | A | | 2/1926 | Efford et al. | |
| 1,821,722 | A | | 9/1931 | Neal | |
| 2,411,448 | A | * | 11/1946 | McLean | 248/289.11 |
| 2,437,647 | A | * | 3/1948 | McLean | 248/289.11 |
| 2,486,279 | A | | 10/1949 | Hathaway | |
| 2,677,415 | A | * | 5/1954 | Brink | 297/411.21 |
| 3,075,735 | A | * | 1/1963 | Skinner | 248/251 |
| 3,082,473 | A | | 3/1963 | West | |
| 3,183,877 | A | | 5/1965 | Benzel | |
| 3,329,385 | A | | 7/1967 | Dietsch | |
| 3,675,785 | A | | 7/1972 | Martin | |
| 3,766,598 | A | * | 10/1973 | Roberts | 16/444 |
| 4,074,884 | A | | 2/1978 | Antoszewski | |
| 4,131,259 | A | | 12/1978 | Franks | |

(Continued)

FOREIGN PATENT DOCUMENTS

JP 10311668 A * 11/1998

(Continued)

*Primary Examiner*—Chuck Y. Mah
(74) *Attorney, Agent, or Firm*—Price, Heneveld, Cooper, DeWitt & Litton, LLP

(57) ABSTRACT

A hand bracket comprising a grip section, a top connection bracket at a first end of the grip section and a bottom connection bracket a second end of the grip section. At least one of the top connection bracket and the bottom connection bracket comprises a shell having two screw holes and a rim, with screw cylinders extending from the screw holes to a position planar with the rim. The at least one of the top connection bracket and the bottom connection bracket includes a first side and a second side, with the two screw holes located closer to one of the first side or the second side.

22 Claims, 6 Drawing Sheets

U.S. PATENT DOCUMENTS

| | | | | |
|---|---|---|---|---|
| 4,194,637 | A | 3/1980 | Edson | |
| 4,335,862 | A | 6/1982 | Sherman | |
| 4,354,690 | A | 10/1982 | Hanson | |
| 4,976,455 | A | 12/1990 | Brammer, Sr. et al. | |
| 5,050,252 | A * | 9/1991 | Cuttriss | 4/576.1 |
| 5,078,276 | A | 1/1992 | Rogge et al. | |
| 5,191,837 | A * | 3/1993 | Bolton | 101/333 |
| 5,332,109 | A | 7/1994 | Johnson | |
| 5,342,015 | A | 8/1994 | Burton et al. | |
| 5,632,062 | A * | 5/1997 | Katz et al. | 16/412 |
| 5,887,927 | A | 3/1999 | Kurek, III et al. | |
| 6,131,213 | A | 10/2000 | Sarff | |
| 6,276,027 | B1 | 8/2001 | Hanna | |
| 6,308,843 | B1 | 10/2001 | De Boer | |
| 6,464,189 | B1 | 10/2002 | Yu | |
| D470,397 | S | 2/2003 | Valiulis et al. | |
| 6,581,245 | B2 | 6/2003 | Jen | |
| 6,595,571 | B1 | 7/2003 | Krebs et al. | |
| 6,895,635 | B2 * | 5/2005 | Tisol et al. | 16/110.1 |
| 6,974,134 | B1 * | 12/2005 | Macri et al. | 296/1.02 |
| 2003/0029974 | A1 | 2/2003 | Marshall et al. | |
| 2003/0056334 | A1 * | 3/2003 | Finkelstein | 16/436 |

FOREIGN PATENT DOCUMENTS

| | | | |
|---|---|---|---|
| JP | 11117484 | A * | 4/1999 |
| JP | 11117487 | A * | 4/1999 |
| JP | 2001193248 | A * | 7/2001 |
| JP | 2002095612 | A * | 4/2002 |

* cited by examiner

HAND BRACKET

CROSS-REFERENCE TO RELATED APPLICATION

This application is a continuation-in-part of U.S. patent application Ser. No. 29/215,840, which was filed on Oct. 26, 2004 now U.S Pat. No. D,516,406 and entitled HAND BRACKET.

BACKGROUND

The present invention pertains to hand brackets, and in particular, to a hand bracket specially suited for use on a marine vessel, motor home, travel trailer or other recreational vehicle.

Many recreational vehicles and vessels provide a series of steps and an associated hand bracket along their outer surfaces to accommodate easy access thereto.

However, due to the mobility of the vehicle or the like, the hand bracket can be adjustably constructed to avoid interference with the desired travel. One common approach is to detachably secure the hand bracket to the vehicle so that it may be removed for travel. An example of such a construction is disclosed in U.S. Pat. No. 4,664,227 issued May 12, 1987 to Hansen, and entitled PORTABLE BALUSTRADE AND PLATFORM ASSEMBLY. However, while such arrangements avoid travel interference, they involve labor-intensive and time-consuming operations to attach and detach, and therefore often become a nuisance to the user. Furthermore, suitable and easily-accessible storage space must be provided for receiving the hand bracket during travel. Also, the various fasteners utilized to assemble and attach the hand bracket must be kept track of to ensure that they will not become lost or erroneously used in the subsequent erection and attachment of the hand bracket. This problem is especially acute if the hand bracket is to be stored for a long duration before reassembling.

In an effort to alleviate these difficulties, past artisans have also developed collapsible hand brackets, such as disclosed in: U.S. Pat. No. 4,720,116 issued Jan. 19, 1988 to Williams et al., and entitled STORABLE STAIRWAY AND PLATFORM APPARATUS FOR RECREATIONAL VEHICLES; U.S. Pat. No. 3,997,211 issued Dec. 14, 1976 to Graves, and entitled RETRACTABLE PATIO ASSEMBLY FOR USE ON A PICKUP TRUCK MOUNTED CAMPER OR THE LIKE; and U.S. Pat. No. 3,912,298 issued Oct. 14, 1975 to Humphrey, and entitled FOLDABLE STEPS FOR MOBILE HOME. However, these hand brackets typically involve a plurality of pivotally interconnected segments which cooperate to effect collapse of the hand bracket against the vehicle in a vertical plane or elements which fold against an enlarged horizontal porch section before collapsing against the side of the vehicle. These arrangements greatly increase the complexity of the hand bracket and invariably increase the cost of fabrication and the susceptibility to disrepair.

Accordingly, an apparatus is desired having the aforementioned advantages and solving and/or making improvements on the aforementioned disadvantages.

SUMMARY OF THE PRESENT INVENTION

An aspect of the present invention is to provide a hand bracket comprising a grip section, a top connection bracket at a first end of the grip section and a bottom connection bracket at a second end of the grip section. At least one of the top connection bracket and the bottom connection bracket comprises a shell having two screw holes and a rim, with screw cylinders extending from the screw holes to a position planar with the rim. The at least one of the top connection bracket and the bottom connection bracket includes a first side and a second side, with the two screw holes located closer to one of the first side or the second side.

Another aspect of the present invention is to provide a hand bracket comprising a grip section, a top connection bracket at a first end of the grip section and a bottom connection bracket at a second end of the grip section. The grip section has an upper portion and a lower portion. The top connection bracket includes an upper slot for selectively accepting the upper portion of the grip section. The top connection bracket further includes at least one top stowing groove for selectively accepting the upper portion of the grip section. The bottom connection bracket includes a lower slot for selectively accepting the lower portion of the grip section. The bottom connection bracket further includes at least one bottom stowing groove for selectively accepting the lower portion of the grip section. The grip section is pivotally connected to the top connection bracket and the bottom connection bracket. The grip section can be moved to a deployed position wherein the upper portion of the grip section is in the upper slot and the lower portion of the grip section is in the lower slot and to a stow position wherein the upper portion of the grip section is in one of the at least one top stowing groove and the lower portion of the grip section is in one of the at least one bottom stowing groove. At least one of the top connection bracket and the bottom connection bracket includes a first side and a second side, with two screw holes located closer to one of the first side or the second side. The upper slot includes a lowest upper point and the bottom slot includes a lowest bottom point, with each of the lowest upper point and the lowest bottom point being substantially equidistant to both the first side and the second side of the at least one of the top connection bracket and the bottom connection bracket.

These and other aspects, objects, and features of the present invention will be understood and appreciated by those skilled in the art upon studying the following specification, claims, and appended drawings.

DETAILED DESCRIPTION OF PREFERRED EMBODIMENTS

Figure 1:
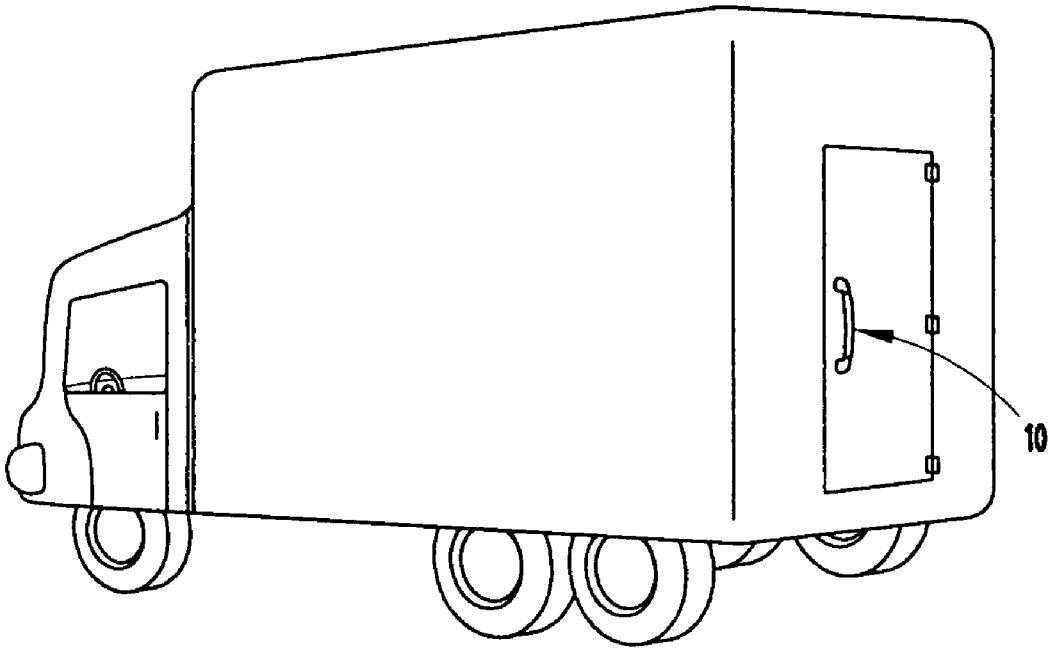
FIG. 1 is a perspective view of a hand bracket of the present invention connected to a door of a recreational vehicle.
Figure 5:
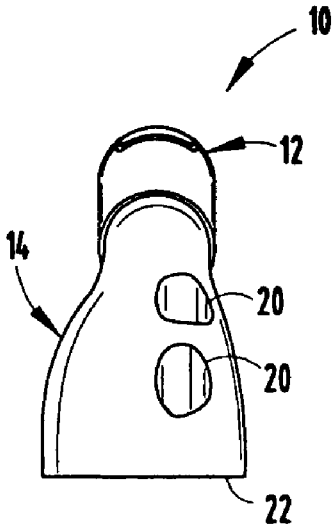
FIG. 5 is a top view of the hand bracket of the present invention.
Figure 6:
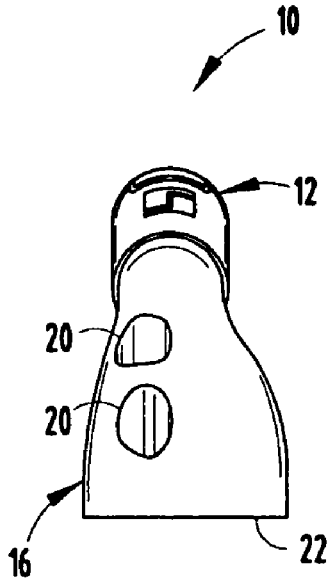
FIG. 6 is a bottom view of the hand bracket of the present invention.
Figure 2:
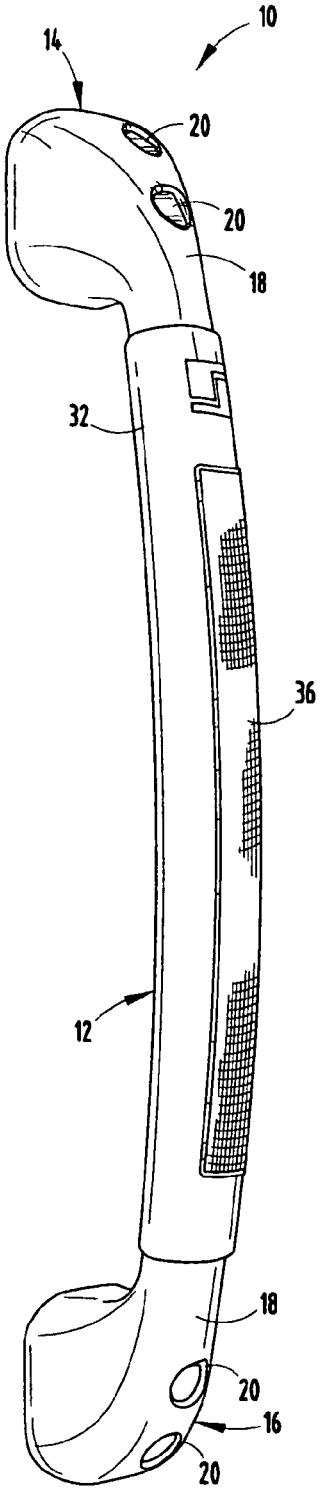
FIG. 2 is a perspective view of the hand bracket of the present invention.
Figure 3:
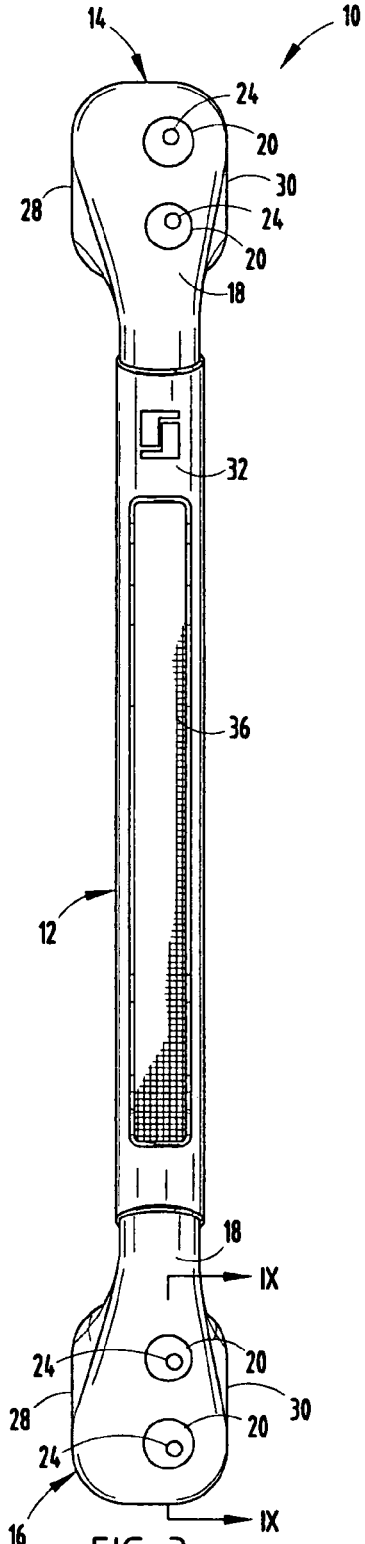
FIG. 3 is a front view of the hand bracket of the present invention.
Figure 4:
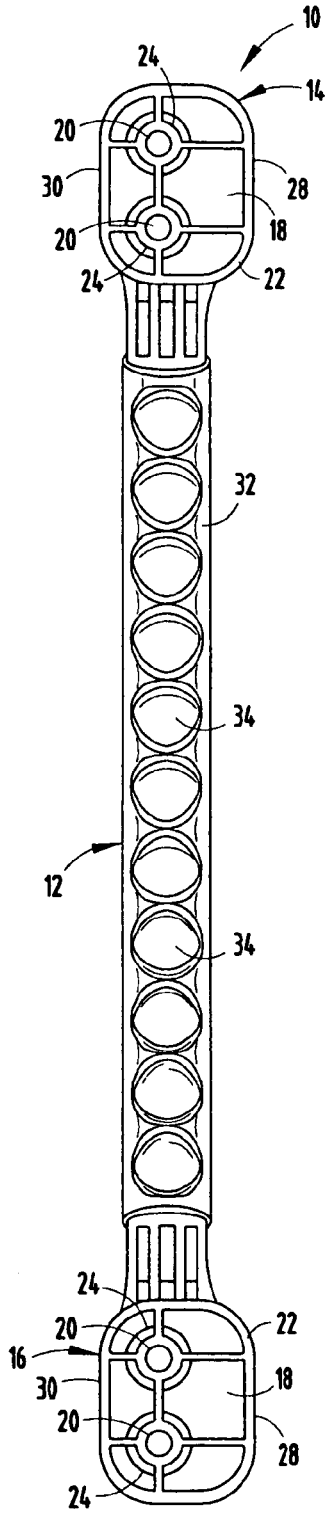
FIG. 4 is a rear view of the hand bracket of the present invention.
Figure 7:
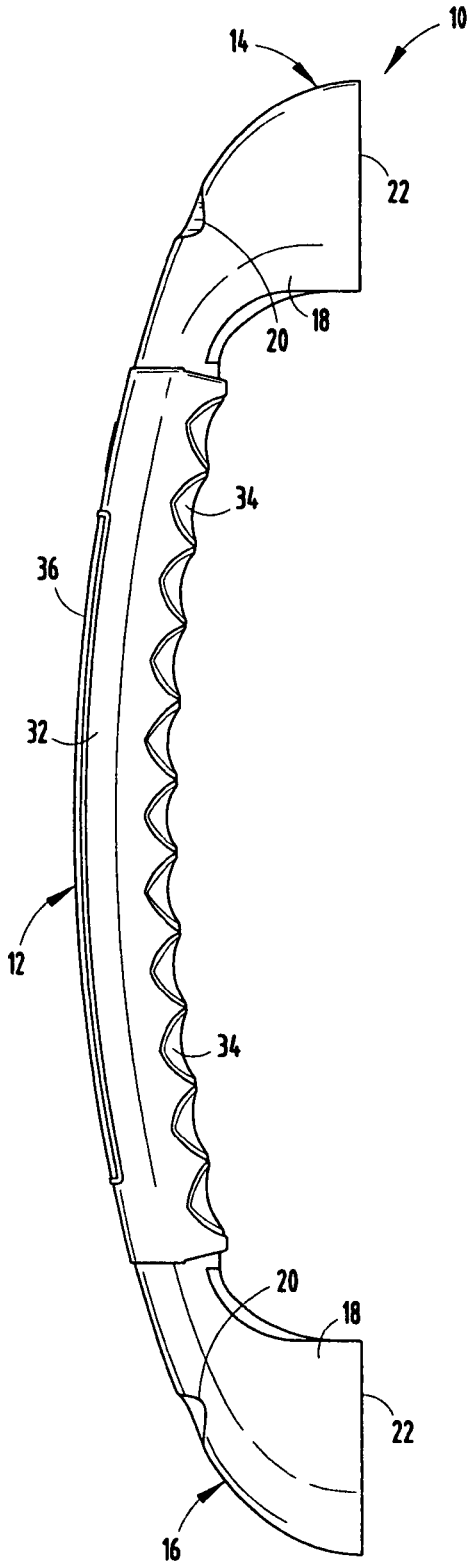
FIG. 7 is a first side view of the hand bracket of the present invention.
Figure 8:
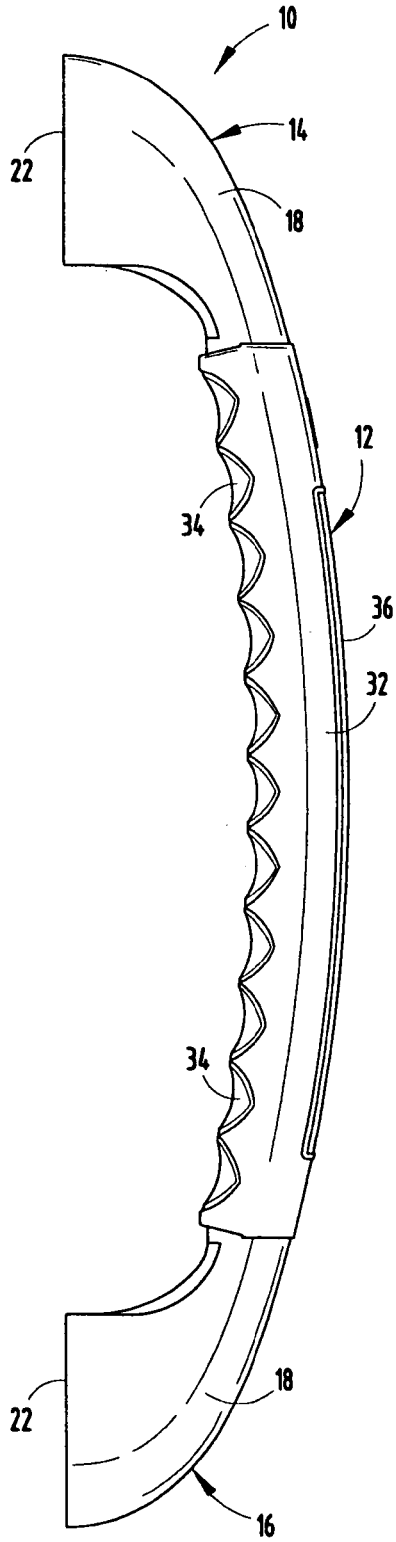
FIG. 8 is a second side view of the hand bracket of the present invention.
Figure 9:
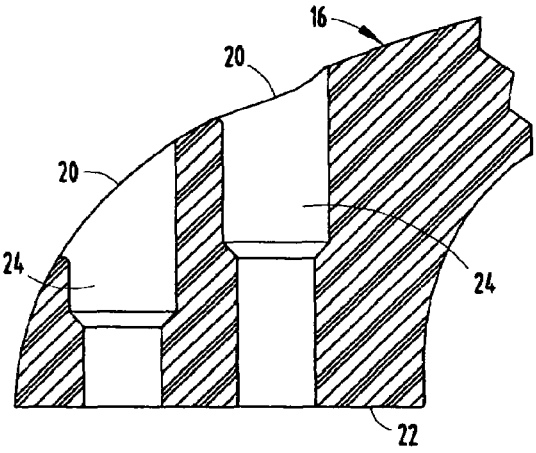
FIG. 9 is a cross-sectional view of the hand bracket taken along line IX-IX of FIG. 3.
Figure 11:
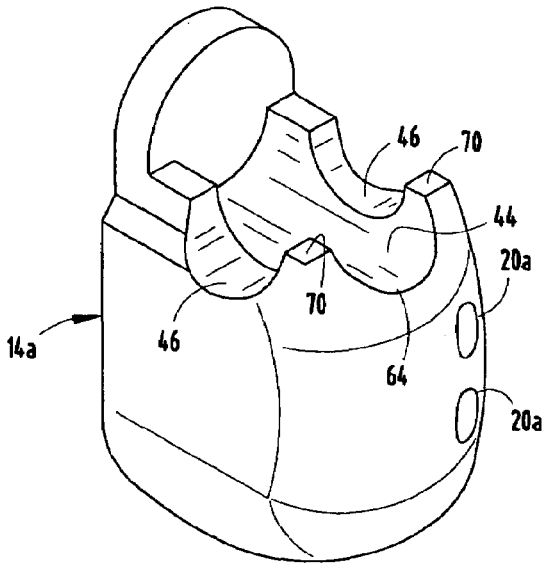
FIG. 11 is a front perspective view of a connection bracket of the second embodiment of the hand bracket of the present invention.
Figure 12:
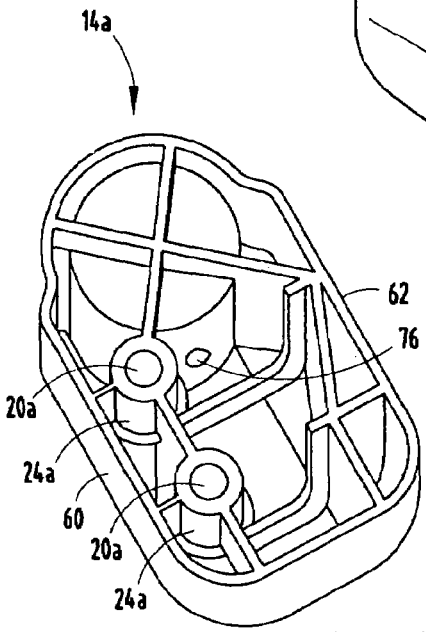
FIG. 12 is a rear perspective view of the connection bracket of the second embodiment of the hand bracket of the present invention.
Figure 10:
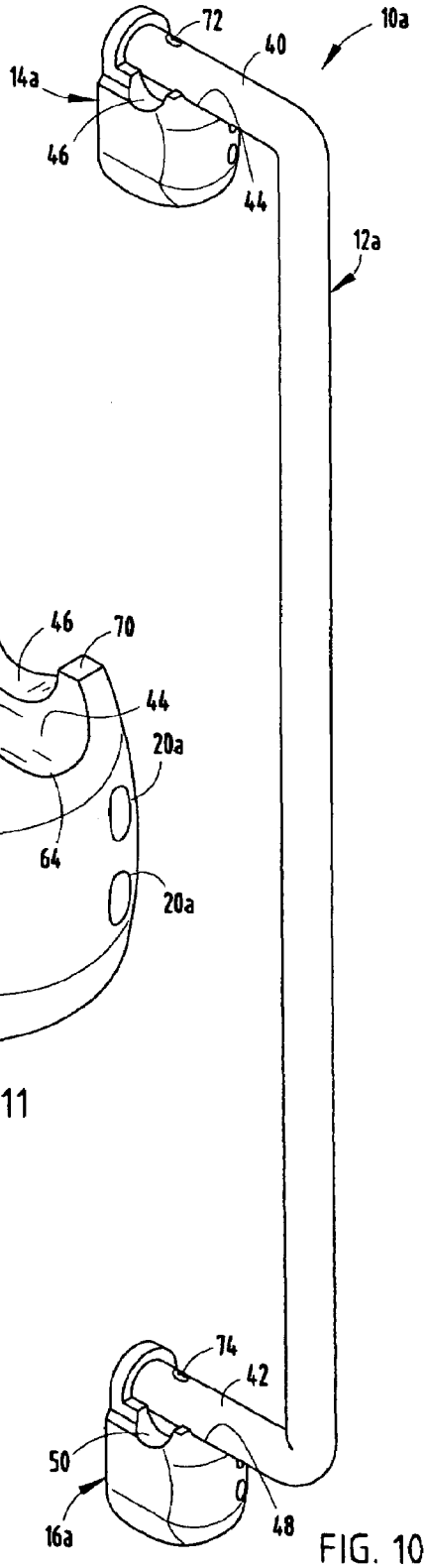
FIG. 10 is a perspective view of a second embodiment of the hand bracket of the present invention in a deployed position.
Figure 13:
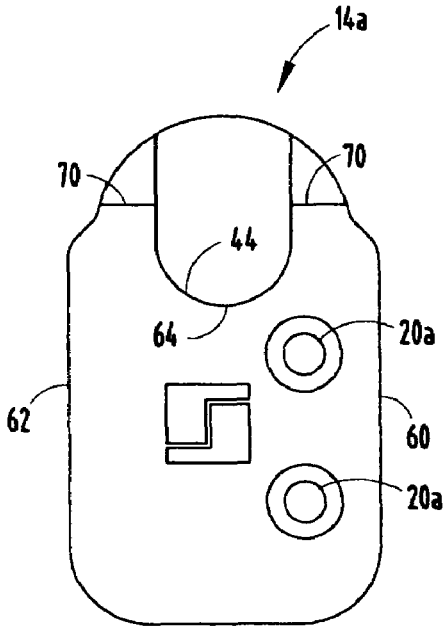
FIG. 13 is a front view of the connection bracket of the second embodiment of the hand bracket of the present invention.
Figure 14:
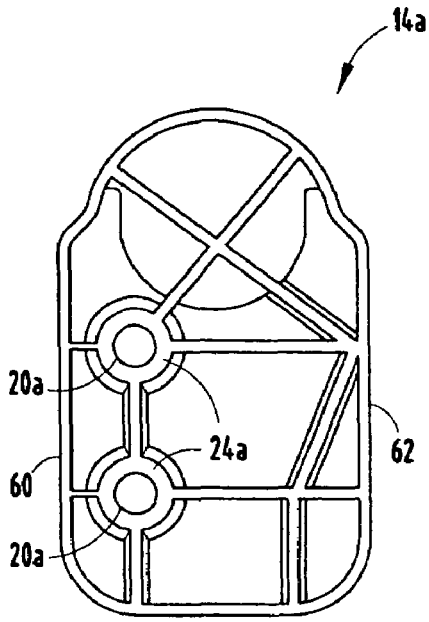
FIG. 14 is a rear view of the connection bracket of the second embodiment of the hand bracket of the present invention.
Figure 15:
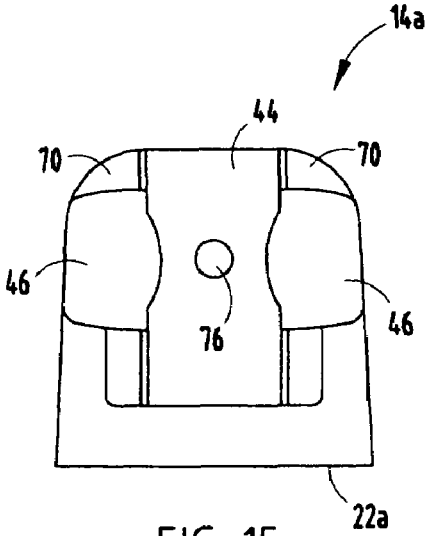
FIG. 15 is a top view of the connection bracket of the second embodiment of the hand bracket of the present invention.
Figure 16:
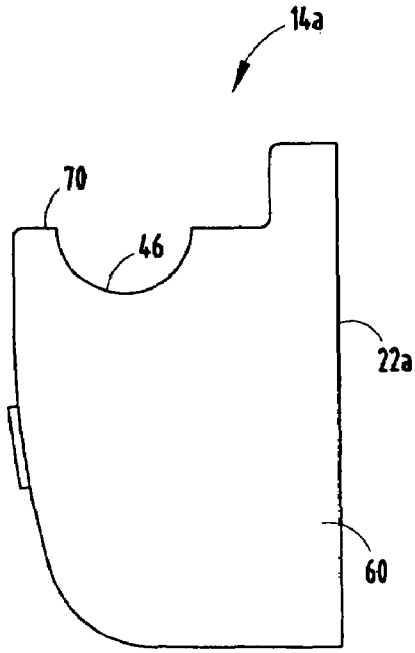
FIG. 16 is a side view of the connection bracket of the second embodiment of the hand bracket of the present invention.
Figure 17:
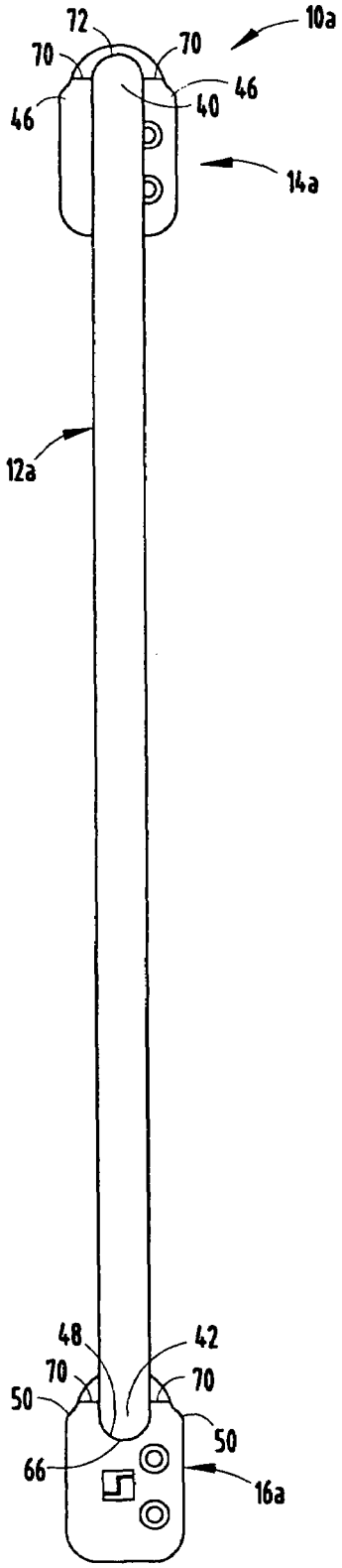
FIG. 17 is a front view of the second embodiment of the hand bracket of the present invention in the deployed position.
Figure 18:
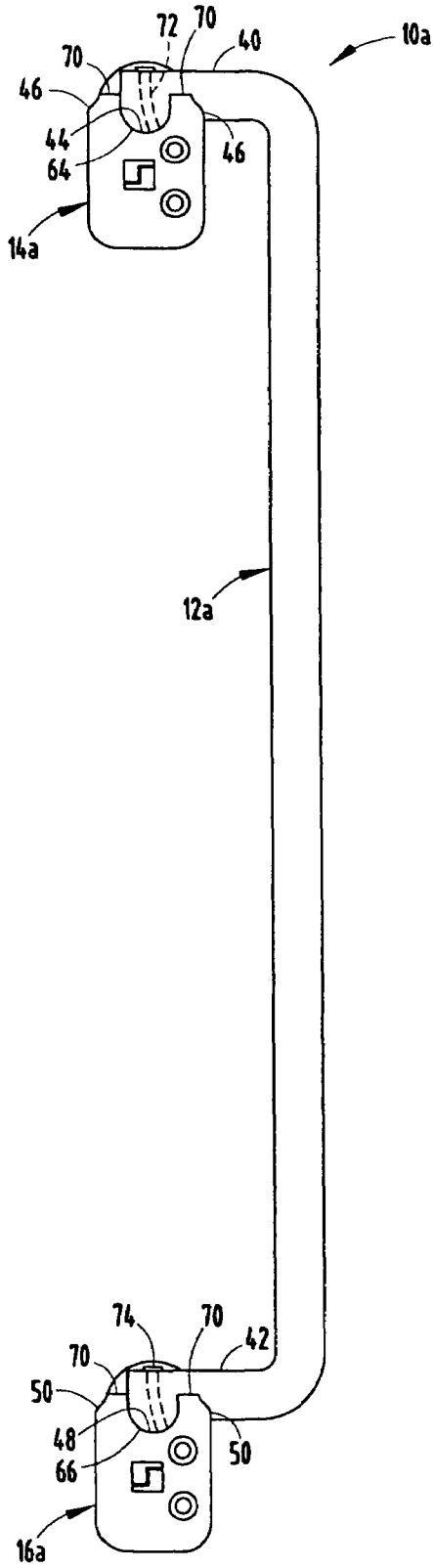
FIG. 18 is a front view of the second embodiment of the hand bracket of the present invention in a stowed position.

For purposes of description herein, the terms "upper," "lower," "right," "left," "rear," "front," "vertical," "horizontal," and derivatives thereof shall relate to the invention as orientated in FIG. 1. However, it is to be understood that the invention may assume various alternative orientations, except where expressly specified to the contrary. It is also to be understood that the specific devices and processes illustrated in the attached drawings, and described in the following specification are simply exemplary embodiments of the inventive concepts defined in the appended claims. Hence, specific dimensions and other physical characteristics relating to the embodiments disclosed herein are not to be considered as limiting, unless the claims expressly state otherwise.

The reference number 10 (FIGS. 1-9) generally designates a hand bracket embodying the present invention. In the illustrated example, the hand bracket 10 comprises a grip section 12, a top connection bracket 14 at a first end of the grip section 12 and a bottom connection bracket 16 at a second end of the grip section 12. At least one of the top connection bracket 14 and the bottom connection bracket 16 comprises a shell 18 having two screw holes 20 and a rim 22, with screw cylinders 24 extending from the screw holes 20 to a position planar with the rim 22. The at least one of the top connection bracket 14 and the bottom connection bracket 16 includes a first side 28 and a second side 30, with the two screw holes 20 located closer to one of the first side 28 or the second side 30.

In the illustrated example, the grip section 12, the top connection bracket 14 and the bottom connection bracket 16 are integral. The grip section 12 includes a bar (not shown) connected to the top connection bracket 14 and the bottom connection bracket 16 and a rubber tube 32 surrounding the bar. The rubber tube 32 includes a bottom surface having finger grooves 34 for accepting fingers of a user of the hand bracket 10. The rubber tube 32 also includes a top surface having gripping protrusions 36 in a cross hatch pattern. The finger grooves 34 and the gripping protrusions 36 allow a user of the hand bracket 10 to easily grasp the grip section 12 of the hand bracket 10.

The reference numeral 10*a* (FIGS. 10-18) generally designates another embodiment of the present invention, having a second embodiment for the hand bracket. Since hand bracket assembly 10*a* is similar to the previously described hand bracket 10, similar parts appearing in FIGS. 1-9 and FIGS. 10-18, respectively, are represented by the same, corresponding reference number, except for the suffix "a" in the numerals of the latter. In the second embodiment of the hand bracket 10*a*, the grip section 12*a*, the top connection bracket 14*a* and the bottom connection bracket 16*a* are separate, but operatively connected. In the illustrated example, the top connection bracket 14*a* and the bottom connection bracket 16*a* are identical, although it is contemplated that they could have different configurations.

The illustrated grip section 12*a* of the second embodiment of the hand bracket 10*a* is configured to move between a deployed position (FIGS. 10 and 17) wherein the grip section 12*a* is accessible for easy use and a stowed position (FIG. 18) wherein the grip section 12*a* is positioned towards a side of the top connection bracket 14*a* and the bottom connection bracket 16*a*. The grip section 12*a* includes an upper portion 40 and a lower portion 42. The top connection bracket 14*a* is at a first end of the grip section 12*a* and the bottom connection bracket 16*a* is at a second end of the grip section 12*a*. The top connection bracket 14*a* includes an upper slot 44 for selectively accepting the upper portion 40 of the grip section 12*a* in the deployed position. The top connection bracket 14*a* further includes a pair of top stowing grooves 46 for selectively accepting the upper portion 40 of the grip section 12*a* in the stowed position. Likewise, the bottom connection bracket 16*a* includes a lower slot 48 for selectively accepting the lower portion 42 of the grip section 12*a* in the deployed position. Furthermore, the bottom connection bracket 16*a* further includes a pair of bottom stowing grooves 50 for selectively accepting the lower portion 42 of the grip section 12*a* is in the stowed position. The grip section 12*a* is pivotally connected to the top connection bracket 14*a* and the bottom connection bracket 16*a*. The illustrated grip section 12*a* is C-shaped and can be moved to a deployed position (FIG. 17) wherein the upper portion 40 of the grip section 12*a* is in the upper slot 44 and the lower portion 42 of the grip section 12*a* is in the lower slot 48 and to the stowed position (FIG. 18) wherein the upper portion 40 of the grip section 12*a* is in one of the top stowing grooves 46 and the lower portion 42 of the grip section 12*a* is in one of the bottom stowing grooves 50. In the illustrated example, the two top stowing grooves 46 are parallel and along a first line, the two bottom stowing grooves 50 are parallel and along a second line, and the first line is parallel to the second line. Furthermore, the upper slot 44 is perpendicular to the top stowing grooves 46 and the lower slot 48 is perpendicular to the bottom stowing grooves 50.

In the illustrated example, the grip section 12*a* is pivotally connected to the top connection bracket 14*a* and the bottom connection bracket 16*a* for moving the grip section 12*a* between the stowed position and the deployed position. The upper portion 40 and the lower portion 42 of the grip section 12*a* are biased into either the upper slot 44 and the lower slot 48, respectively, or one of the top stowing grooves 46 and bottom stowing grooves 50, respectively. The upper slot 44 and the lower slot 48 each include a pair of knobs 70 on each side of the upper slot 44 and lower slot 48 defining a transition between the upper slot 44 and the top stowing grooves 46 and the lower slot 48 and the bottom stowing grooves 50. An upper pin 72 is inserted through the upper portion 40 of the grip section 12*a* and a lower pin 74 is inserted through the lower portion 42 of the grip section 12*a*. The upper pin 72 extends through an opening 76 in the bottom of the upper slot 44 and the lower pin 74 extends through an opening in the bottom of the lower slot 48. An upper spring biases the upper pin 72 and thereby the upper portion 40 of the grip section 12*a* into either the upper slot 44 or one of the top stowing grooves 46. Likewise, a lower spring biases the lower pin 74 and the lower portion 42 of the grip section 12*a* into either the lower slot 48 or one of the bottom stowing grooves 50. The grip section 12*a* is moved from the deployed position to the stowed position by lifting up the upper portion 40 and the lower portion 42 of the grip section 12*a* to a position above the knobs 70 and rotating the grip section 12*a* clockwise or counterclockwise over the knobs 70 and releasing the grip section 12*a* such that the upper portion 40 and the lower portion 42 of the grip section 12*a* is pulled downward by the force of the upper spring and the lower spring into aligned ones of the top stowing grooves 46 and the bottom stowing grooves 50, respectively. The grip section 12*a* is moved back to the deployed position in the same manner. It is contemplated that only one spring could be used. Moving a grip section 12*a* between a stowed position and a deployed position is disclosed in U.S. Pat. No. 4,976,455 entitled HANDRAIL, the entire contents of which are hereby incorporated herein by reference.

In the illustrated example, the top connection bracket 14*a* and the bottom connection bracket 16*a* include a first side 60 and a second side 62, with the two screw holes 20*a* located closer to the first side 60 than the second side 62. It is contemplated, however, that the two screw holes could be located closer to the second side 62 than the first side 60. Furthermore, the upper slot 44 includes a lowest upper point 64 and the bottom slot 48 includes a lowest bottom point 66, with each of the lowest upper point 64 and the lowest bottom point 66 being substantially equidistant to both the first side 60 and the second side 62 of the top connection bracket 14*a* and the bottom connection bracket 16*a*. Therefore, the grip section 12*a* is centered on the hand bracket 10*a*.

It is to be understood that variations and modifications can be made on the aforementioned structure without departing from the concepts of the present invention, and further it is to be understood that such concepts are intended to be covered by the following claims unless these claims by their language expressly state otherwise.

We claim:

1. A hand bracket comprising:

a grip section;

a top connection bracket at a first end of the grip section; and a bottom connection bracket at a second end of the grip section;

at least one of the top connection bracket and the bottom connection bracket comprising a shell having two screw holes and a rim, with screw cylinders extending from the screw holes to a position planar with the rim;

wherein the at least one of the top connection bracket and the bottom connection bracket includes a first side and a second side, with the two screw holes located closer to one of the first side or the second side.

2. The hand bracket of claim 1, wherein:

the grip section includes a rubber tube.

3. The hand bracket of claim 2, wherein:

the rubber tube includes finger grooves for accepting fingers of a user of the hand bracket.

4. The hand bracket of claim 2, wherein:

the rubber tube includes gripping protrusions.

5. The hand bracket of claim 1, wherein:

the at least one of the top connection bracket and the bottom connection bracket comprises both the top connection bracket and the bottom connection bracket.

6. The hand bracket of claim 1, wherein:

the grip section, the top connection bracket and the bottom connection bracket are integral.

7. The hand bracket of claim 6, wherein:

the grip section includes a rubber tube.

8. The hand bracket of claim 7, wherein:

the rubber tube includes finger grooves for accepting fingers of a user of the hand bracket.

9. The hand bracket of claim 7, wherein:

the rubber tube includes gripping protrusions.

10. The hand bracket of claim 1, wherein:

the grip section, the top connection bracket and the bottom connection bracket are separate, but operatively connected.

11. The hand bracket of claim 1, wherein:

the grip section comprises a C-shaped handle.

12. The hand bracket of claim 1, wherein:

the grip section includes an upper portion and a lower portion;

the top connection bracket includes an upper slot for accepting the upper portion of the grip section; and the bottom connection bracket includes a lower slot for accepting the lower portion of the grip section.

13. The hand bracket of claim 12, wherein:

the top connection bracket includes at least one top stowing groove;

the bottom connection bracket includes at least one bottom stowing groove;

the grip section is pivotally connected to the top connection bracket and the bottom connection bracket; and the grip section can be moved to a deployed position wherein the upper portion of the grip section is in the upper slot and the lower portion of the grip section is in the lower slot and to a stowed position wherein the upper portion of the grip section is in one of the at least one top stowing groove and the lower portion of the grip section is in one of the at least one bottom stowing groove.

14. The hand bracket of claim 13, wherein:

the at least one top stowing groove comprises two top stowing grooves; and the at least one bottom stowing groove comprises two bottom stowing grooves.

15. The hand bracket of claim 14, wherein:

the two top stowing grooves are parallel and along a first line;

the two bottom stowing grooves are parallel and along a second line;

the first line is parallel to the second line.

16. The hand bracket of claim 13, wherein:

the upper slot is perpendicular to the at least one top stowing groove; and the lower slot is perpendicular to the at least one bottom stowing groove.

17. The hand bracket of claim 12, wherein:

the upper slot includes a lowest upper point and the bottom slot includes a lowest bottom point, each of the lowest upper point and the lowest bottom point being substantially equidistant to both the first side and the second side of the at least one of the top connection bracket and the bottom connection bracket.

18. A hand bracket comprising:

a grip section having an upper portion and a lower portion;

a top connection bracket at a first end of the grip section, the top connection bracket including an upper slot for selectively accepting the upper portion of the grip section, the top connection bracket further including at least one top stowing groove for selectively accepting the upper portion of the grip section; and a bottom connection bracket at a second end of the grip section, the bottom connection bracket including a lower slot for selectively accepting the lower portion of the grip section, the bottom connection bracket further including at least one bottom stowing groove for selectively accepting the lower portion of the grip section;

the grip section being pivotally connected to the top connection bracket and the bottom connection bracket;

wherein the grip section can be moved to a deployed position wherein the upper portion of the grip section is in the upper slot and the lower portion of the grip section is in the lower slot and to a stowed position wherein the upper portion of the grip section is in one of the at least one top stowing groove and the lower portion of the grip section is in one of the at least one bottom stowing groove; and wherein at least one of the top connection bracket and the bottom connection bracket includes a first side and a second side, with two screw holes located closer to one of the first side or the second side; and wherein the upper slot includes a lowest upper point and the bottom slot includes a lowest bottom point, each of the lowest upper point and the lowest bottom point being substantially equidistant to both the first side and the second side of the at least one of the top connection bracket and the bottom connection bracket.

19. The hand bracket of claim 18, wherein:

the at least one top stowing groove comprises two top stowing grooves; and the at least one bottom stowing groove comprises two bottom stowing grooves.

20. The hand bracket of claim 19, wherein:

the two top stowing grooves are parallel and along a first line;

the two bottom stowing grooves are parallel and along a second line;

the first line is parallel to the second line.

21. The hand bracket of claim 18, wherein:

the upper slot is perpendicular to the at least one top stowing groove; and the lower slot is perpendicular to the at least one bottom stowing groove.

22. The hand bracket of claim 18, wherein:

the at least one of the top connection bracket and the bottom connection bracket comprises a shell with the two screw holes, a rim and screw cylinders extending from the screw holes to a position planar with the rim; and the screw holes and the screw cylinders do not have a central axis bisecting a first line extending perpendicular to a second line extending between the top connection bracket and the bottom connection bracket.

* * * * *